US006938784B2

(12) United States Patent
Yang

(10) Patent No.: US 6,938,784 B2
(45) Date of Patent: Sep. 6, 2005

(54) BASKET FRAME

(75) Inventor: Oni Yang, Taipei (TW)

(73) Assignee: Ulike Corporation, Taipei (TW)

( * ) Notice: Subject to any disclaimer, the term of this patent is extended or adjusted under 35 U.S.C. 154(b) by 76 days.

(21) Appl. No.: 10/609,660

(22) Filed: Jul. 1, 2003

(65) Prior Publication Data

US 2005/0001522 A1 Jan. 6, 2005

(51) Int. Cl.[7] ..... A47B 88/00
(52) U.S. Cl. ..... 211/87.1; 312/330.1; 312/348.2
(58) Field of Search ..... 312/348.1, 348.2, 312/348.3, 351, 257.1, 330.1, 184, 265.1; 403/252, 253, 258, 256, 403; 211/182, 183, 126.13, 105.1, 87.01; 220/485

(56) References Cited

U.S. PATENT DOCUMENTS 2,755,157 A * 7/1956 Carbary ..... 312/408
3,269,548 A * 8/1966 Geiger et al. ..... 211/41.8
4,030,610 A * 6/1977 Alexander ..... 211/182
4,527,694 A * 7/1985 Bolt et al. ..... 211/46
5,205,626 A * 4/1993 Fotioo ..... 312/184
5,431,381 A * 7/1995 Smed ..... 269/43
5,515,980 A * 5/1996 Fotioo ..... 211/46
5,692,431 A * 12/1997 Herring ..... 99/426
6,166,916 A * 12/2000 Jelinger ..... 361/756

* cited by examiner

*Primary Examiner*—Janet M. Wilkens
(74) *Attorney, Agent, or Firm*—Troxell Law Office, PLLC

(57) ABSTRACT

A basket frame including a left side frame, a right side frame, a front side frame, a backside frame and four joints. Each of the left side frame and the right side frame have a leading groove slidable on one of two sliding rails. Each of the front side frame and the back side frame having a fitting groove, at least one pair of supporting seats installed opposite in the fitting groove for supporting one of a hanging rod and a hanging basket. One end of each joint has inserting blocks which are inserted into one end of one of the left and the right side frame, and the other end of each joint having an inserting groove for receiving one end of one of the front side frame and the back side frame. The four side frames are assembled by the joints. A width of the basket frame is changed by adjusting an inserting depth of each of the front side frame and the back side frame inserted into the joints.

6 Claims, 5 Drawing Sheets

BASKET FRAME

BACKGROUND OF THE INVENTION (1) Field of the Invention

This invention relates to a basket frame, especially a basket frame that can be assembled quickly and adjusted in width so as to get more convenience in assembling process and improve the appearance of the basket frame.

(2) Description of the Prior Art

The draw basket frame is usually used in the wardrobe, display window or various cabinets, such as shown in FIG. 1, the basket frame 20 being composed of a left side frame, a right side frame 201, a front side rod and a back side rod 202 connected to the left side frame and the right side frame 201. The left side frame and the right side frame 201 can be slid respectively on two sliding rails 203 which are installed on inner wall of the cabinet, thus the rectangular basket frame 20 can be drawn out from or pushed into the cabinet freely. The size of the hanging basket 8 is smaller than that of the basket frame 20 hung and can be hanged on the basket frame 20, the four corners of the hanging basket 8 having respectively a hanging hook 81 which can be hung on the front side rod and the back side rod 202 fo the basket frame.

However, the hanging hooks 81 extend out from the hanging basket 8, the hanging hooks may hook the clothes when the user is taking the clothes out from the hanging basket 8, further, the conventional basket frame 20 only can be equipped with the hanging basket 8, the other accessories, such as hanging rod or necktie box, can't be installed on the conventional basket frame 20. It is convenient for the user to utilize the conventional basket frame for installing various accessories.

SUMMARY OF THE INVENTION

It is therefore the main object of this invention to provide a basket frame which can be assembled quickly and equipped with various accessories and can be changed in its width. The basket frame is composed of a left side frame, a right side frame, a front side frame, a back side frame and four joints, the left side frame and the right side frame having respectively a leading groove which can be slid on a sliding rail to be drew out from or pushed into the cabinet. The front side frame and the back side frame have respectively a fitting groove, at least one or more pairs of supporting seats can be installed opposite in the fitting groove of the front side frame and the back side frame for supporting hanging rod or hanging basket, further, the four side frames can be assembled to connect with each other quickly by the four joints.

It is another object of this invention to provide a basket frame which can be assembled quickly by means of joints, the joint being formed into L-shape, one end of the joint having two inserting blocks which can be inserted into one end of the left side frame or the right side frame and fixed by bolts, the other end of the joint having a inserting groove for receiving one end of the front side frame or the back side frame and fixed by bolts, such that, the four side frame can be assembled quickly by the four joints.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Figure 1:
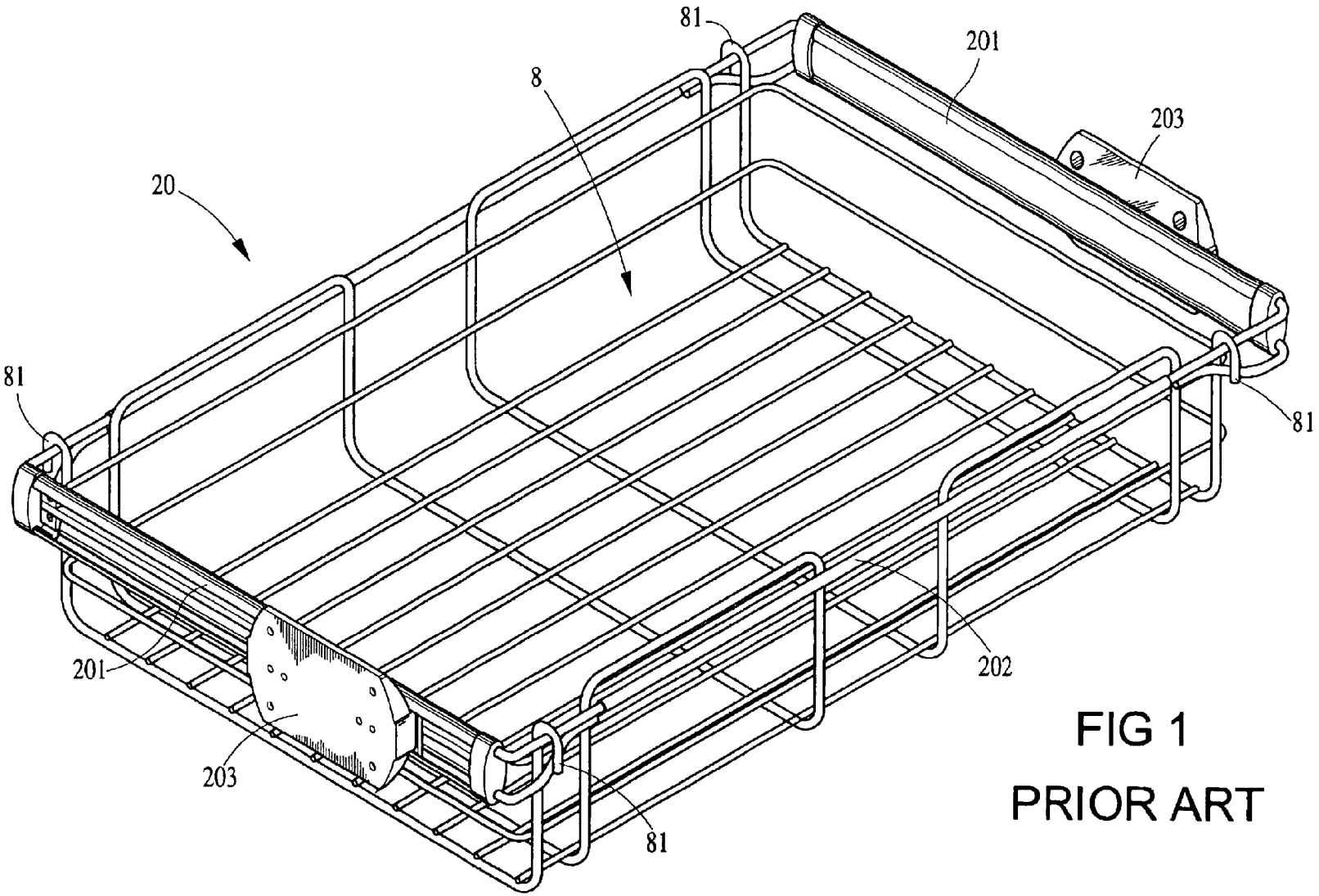
FIG 1 PRIOR ART
FIG. 1 is a perspective view showing the conventional basket frame.
Figure 2:
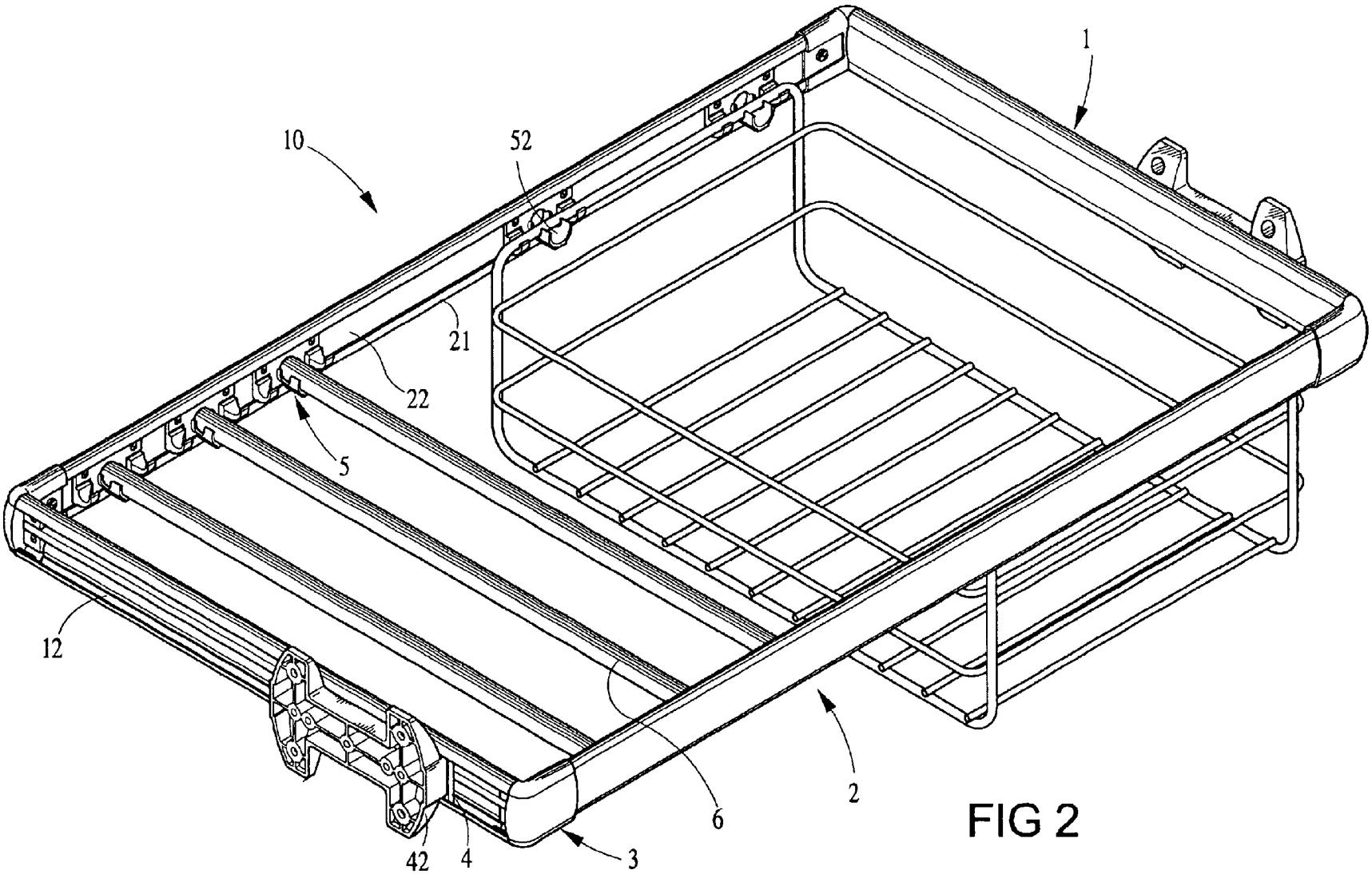
FIG. 2 is a perspective view showing a frame basket of this invention.
Figure 3:
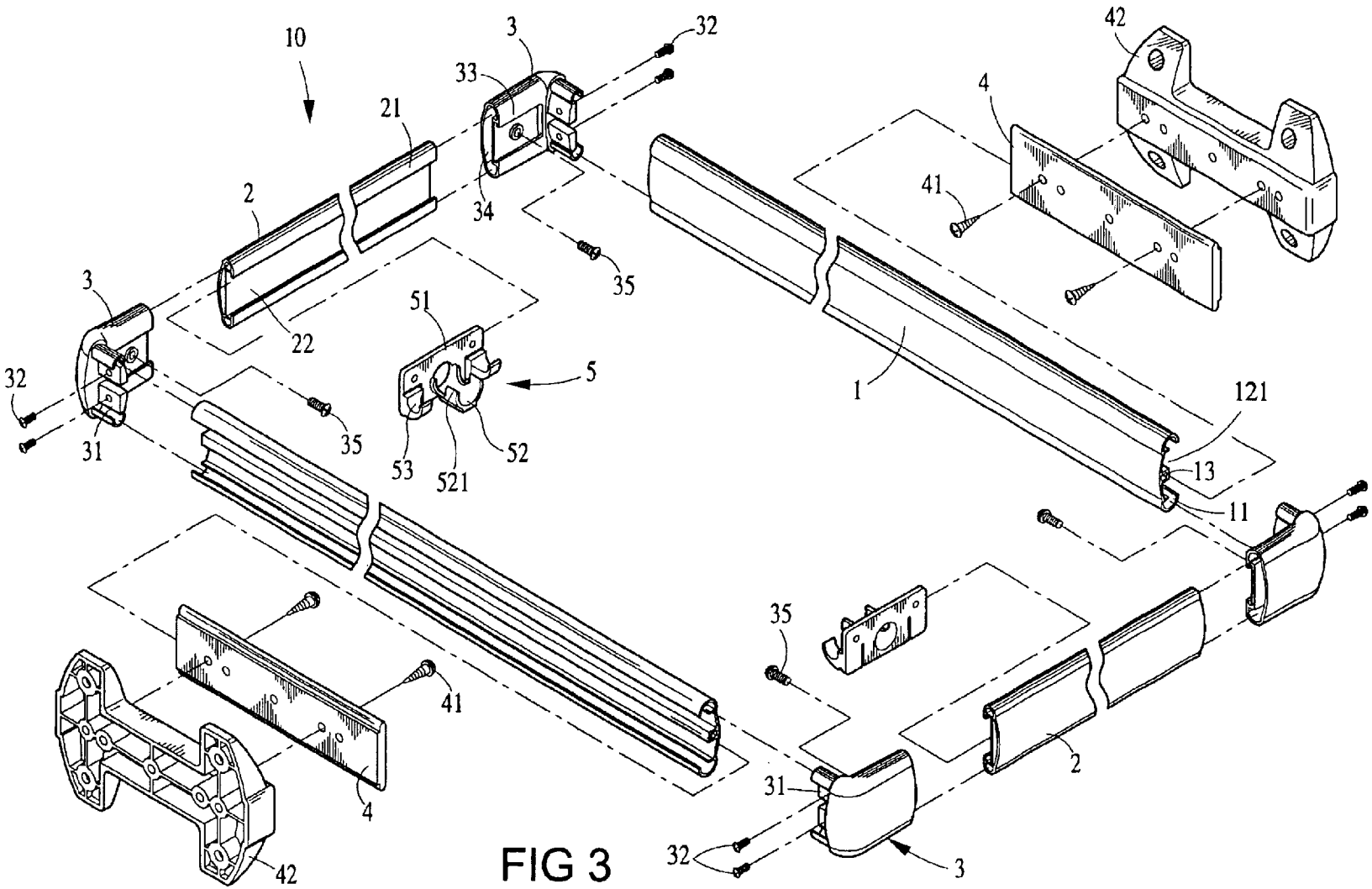
FIG. 3 is an exploded view showing the frame basket of this invention.

Referring to FIG. 2 and FIG. 3, the present invention, a basket frame 10, is used in the wardrobe, display window or various cabinets, the basket frame 10 can be pulled out from or pushed back into the above wardrobe or cabinets by means of a pair of sliding rails installed in the wardrobe or cabinets. The basket frame 10 is composed of left and right side frames 1; front and backside frames 2 and four joints 3.

The left and the right side frames 1 is made of extruding aluminum, the top and bottom end of the left side frame or the right side frame 1 having respectively a hook part 11 so as to form a leading groove 12. A sliding rail 4 is installed respectively on a fixing seat 42 by bolts 41, and the fixing seats 42 being fixed on two inner walls of the wardrobe or cabinet, thus the leading groove 12 of the left and the right side frames 1 can slide on the sliding rails 4, further, the center of the leading groove 12 having a reinforced rib 13 to separate the leading groove 12 into two areas 121, 122.

Figure 4:
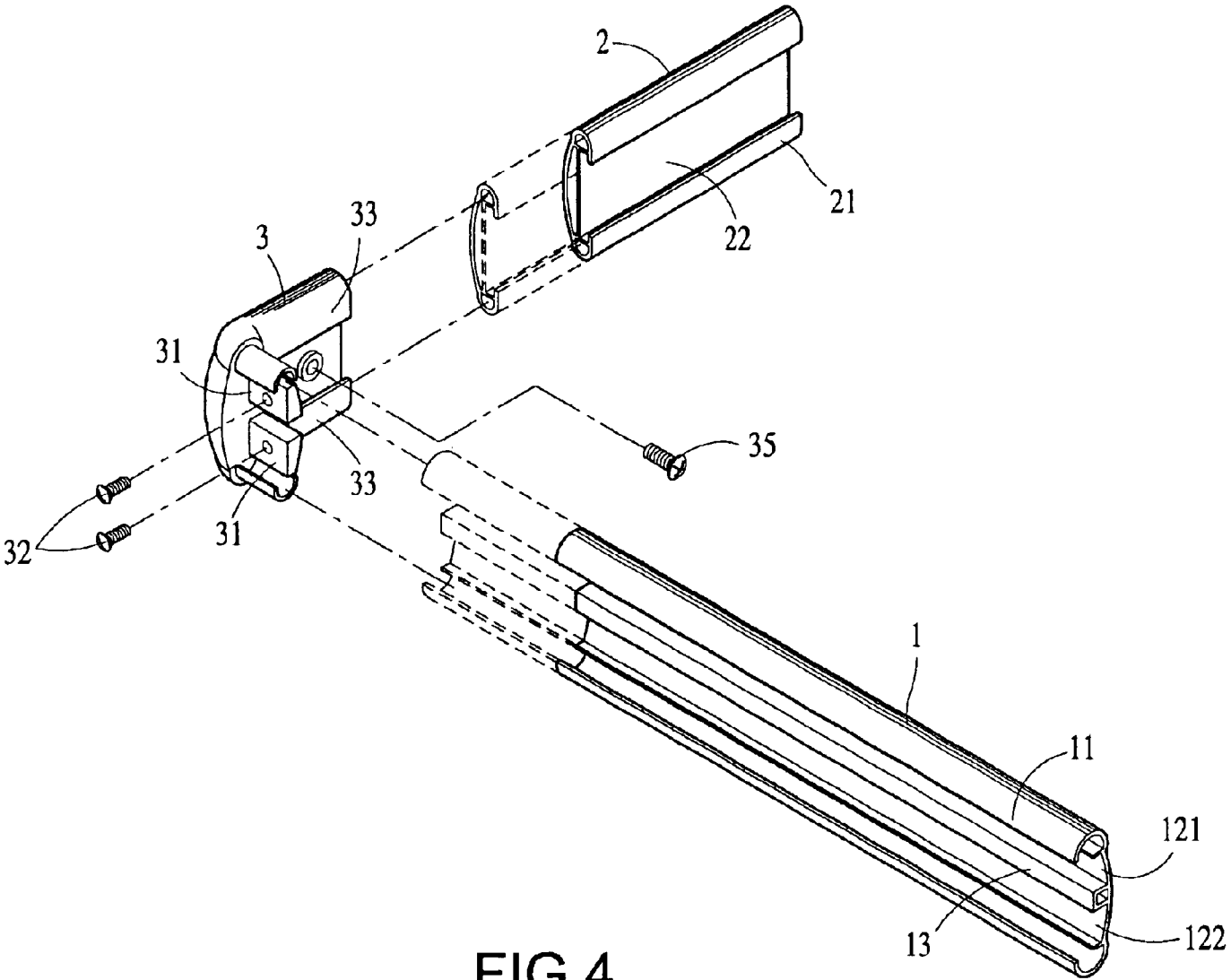
FIG. 4 is a perspective view showing the joint connected with the frame.

Please refer to FIG. 3 and FIG. 4, the front and the back side frames 2 is made of extruding aluminum, the top and bottom end of the front side frame or the back side frame 2 having respectively a hook part 21 to form a fitting groove 22, at least one or more pairs of supporting seats 5 being installed respectively on the fitting grooves 22 of the front side frame and the back side frame 2 for supporting the hanging rod 6 or the hanging basket 7.

The joints 3 are installed on the corner of the basket frame 10 to connect the four side frames. Each joint 3 is made into L-shape, one end of the joint 3 having two inserting blocks 31 which can be inserted into and fixed on the two areas 121, 122 of the left side frame or the right side frame 1 by fixing bolts 32, and the other end of the joint being formed into hook shape 33 and having an inserting groove 34 for receiving the end of the front side frame or the back side frame 2 so as to adjust the width of the frame basket 10 by means of an adjusting bolt 35.

The supporting seat 5 is composed of a locating plate 51 which can be inserted into the fitting groove 22 of the front side frame or the back side frame 2, a curve supporting rack 52 on the locating plate 51, and two supporting hooks 53 formed at two side of the curve supporting rack 52. Two ends of the curve supporting rack 52 is formed into elastic plate 521 for receiving the end of a hanging rod, further, the frame 71 of a hanging basket 7 can be hanged on the supporting hooks 53 of the supporting seat 5 installed between the front side frame and the back side frame 2, such as shown in FIG. 2 and FIG. 3.

Figure 5:
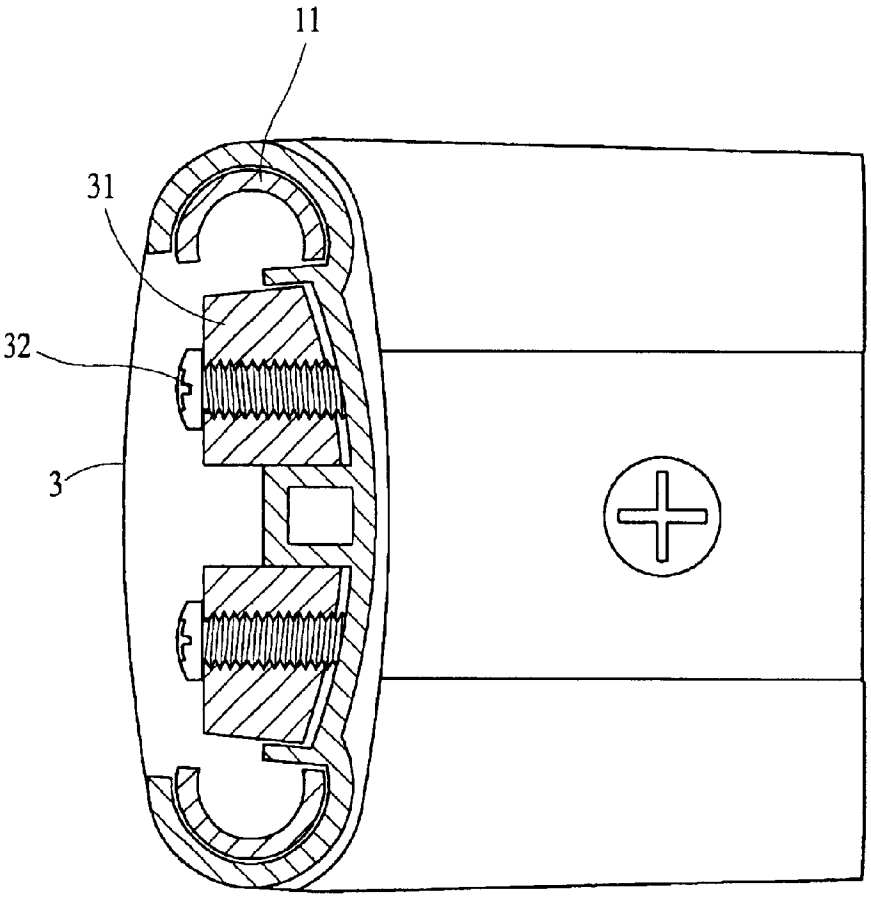
FIG. 5 is a partial sectional view showing the joint connected with the left and the right side frame.

FIG. 3 and FIG. 4 shows the assembling process of this basket frame 10, the two inserting blocks 31 of the joint 3 can be inserted into the area 121,122 of the leading groove 12 of the left side frame and the right side frame 1, thus the joint 3 can be fixed on one end of the left side frame and the right side frame 1 by screwing the fixing bolts into the two inserting blocks 31 and the left side frame and the right side frame, such as shown in FIG. 5.

Figure 6:
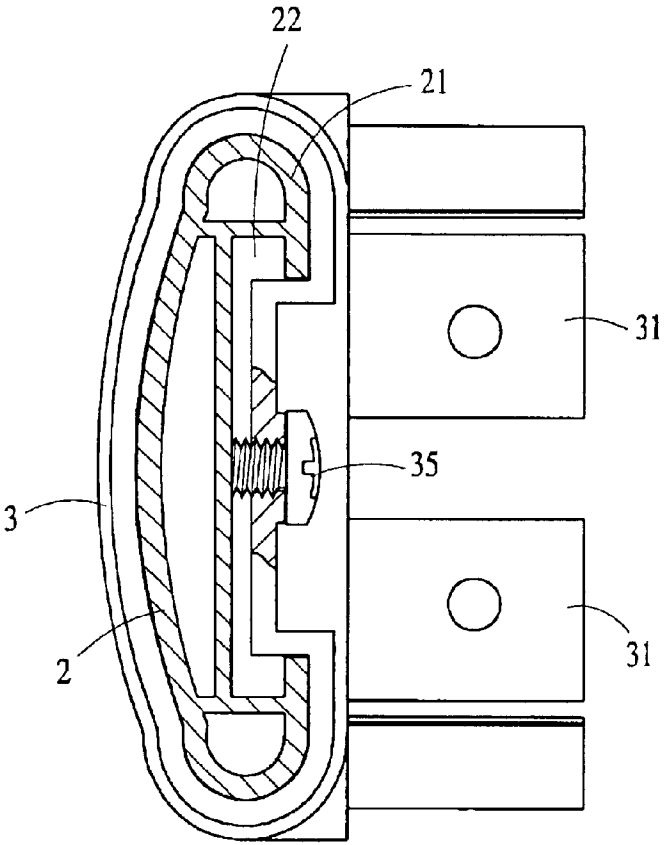
FIG. 6 is a partial sectional view showing the joint connected with the front and the backside frame.

At least one or more pairs of supporting seats 5 are installed respectively in the fitting groove 22 of the front side frame and the back side frame 2, further, the supporting seats 5 can be moved freely in the fitting groove 22 to align with each other, then the supporting seats 5 can be fixed in the fitting groove 22 by bolts. Two ends of the front side frame and the back side frame 2 can be inserted respectively into the inserting groove 34 of the above joint 3, such as shown in FIG. 6, thus the width of the basket frame 10 can be changed by adjusting the inserting depth of two ends of the front side frame and the back side frame 2 inserted into the joints 3, at last, the another end of the joint 3 can be connected with one end of the front side frame or the back side frame 2 by the adjusting bolts 35. Accordingly, the basket frame 10 can be assembled quickly by the joints 3; further, the hanging rod 6 and the hanging basket 7 can be hanged on the opposite supporting seats 5 firmly.

It is understood by those skilled in the art that the forgoing description is a preferred embodiment of the disclosed device and that various changes and modifications may be made in the invention without departing from the spirit and scope thereof.

What is claimed is:

1. A basket frame comprising:

a left frame and a right frame, each of the left and right frames having a leading groove;

a front frame and a back frame, each of the front and back frames having a fitting groove;

four joints, a first end of each of the four joints being inserted into the leading groove of said left frame and said right frame, a second end of each of the four joints having an inserting groove for receiving one end said front frame and said back frame, such that the left, right, front and back frames are assembled by the four joints to form the basket frame;

two sliding rails, the leading groove of each of said left frame and said right frame is slidably connected to one of the two sliding rails; and at least one pair of supporting seats, each of the at least one pair of supporting seats being installed on the fitting groove of one of said front frame and said back frame for supporting one of a hanging rod and a hanging basket.

2. A basket frame according to claim 1, wherein top and bottom ends of each of said left frame and said right frame having a hook part forming the leading groove.

3. A basket frame according to claim 1, wherein a center of the leading groove of said left frame and said right frame having a reinforced rib separating the leading groove into two areas.

4. A basket frame according to claim 1, further comprising two fixing seats, each of the two sliding rails is connected to one of the two fixing seats by a plurality of bolts.

5. A basket frame according to claim 1, wherein top and bottom ends of each of said front frame and said back frame having a hook part forming the fitting groove.

6. A basket frame according to claim 1, wherein each of four joints has an L-shape, the first end of each of the four joints having two inserting blocks inserted into one of the two areas of the leading groove of one of said left frame or said right frame, the second end of each of the four joints having an inserting groove for receiving one end of said front frame and said back frame, wherein a width of said basket frame is adjustable by changing an inserting depth that each of said front frame and said back frame is inserted into the inserting groove.

* * * * *